US006000704A

United States Patent [19]

Balbinot et al.

[11] Patent Number: 6,000,704

[45] Date of Patent: Dec. 14, 1999

[54] SKATE WITH NON-RIGID UPPER AND STIFFENING ELEMENT

[75] Inventors: Renzo Balbinot, Pieve Di Soligo; Valerio Tonel, Biadene; Flavio Bacchiega, Montebelluna, all of Italy

[73] Assignee: Benetton Sportsystem S.p.A., Trevignano, Italy

[21] Appl. No.: 09/099,353

[22] Filed: Jun. 18, 1998

[30] Foreign Application Priority Data

Jun. 26, 1997 [IT] Italy ..... TV97A0086

[51] Int. Cl.[6] ..... A43B 5/16

[52] U.S. Cl. ..... 280/11.3; 280/7.13; 36/100; 36/115; 36/15

[58] Field of Search ..... 280/7.1, 7.13, 280/11.3, 11.19, 11.22, 11.27; 36/100, 101, 115, 132, 15

[56] References Cited

U.S. PATENT DOCUMENTS

| | | | |
|---|---|---|---|
| 3,807,062 | 4/1974 | Spier . | |
| 3,975,840 | 8/1976 | Juzenko | 36/101 |
| 4,353,173 | 10/1982 | Paquet | 36/101 |
| 4,706,392 | 11/1987 | Yang | 36/101 |
| 4,974,344 | 12/1990 | Ching | 36/101 |
| 5,083,385 | 1/1992 | Halford | 36/101 |
| 5,397,141 | 3/1995 | Hoshizaki et al. | 280/11.3 |
| 5,437,466 | 8/1995 | Meibock et al. | 280/11.22 |
| 5,491,911 | 2/1996 | Chen | 36/115 |
| 5,645,288 | 7/1997 | Lu | 280/11.19 |
| 5,768,807 | 6/1998 | Caeran et al. | 36/115 |
| 5,784,809 | 7/1998 | McDonald | 36/115 |
| 5,806,211 | 9/1998 | Pozzobon | 36/115 |

FOREIGN PATENT DOCUMENTS

| | | |
|---|---|---|
| 362680 | 6/1981 | Austria . |
| 0765614 | 4/1997 | European Pat. Off. . |
| 0774217 | 5/1997 | European Pat. Off. . |
| 3043425A | 7/1982 | Germany . |
| 95 15094A | 6/1995 | WIPO . |

*Primary Examiner*—Lanna Mai
*Assistant Examiner*—Andrew J. Fischer
*Attorney, Agent, or Firm*—Guido Modiano; Albert Josif

[57] ABSTRACT

A skate provided with a supporting frame for in-line wheels and comprising a shoe which is composed of a nonrigid upper that, in a sandwich-like fashion, surrounds a stiffening element which affects the regions of the tip, of the heel, of the ankle and of the sole of the foot, and a lateral band or rim made of rubber which externally and laterally surrounds said upper proximate to said region of the sole of the foot. An anchoring sole for the frame is formed thereat. A skate is obtained which at the same time allows optimum transmission of forces from the foot to the wheel supporting frame and optimum fit for the user's foot.

19 Claims, 9 Drawing Sheets

SKATE WITH NON-RIGID UPPER AND STIFFENING ELEMENT

BACKGROUND OF THE INVENTION

The present invention relates to a skate.

Conventional skates are normally constituted by a rigid shell which is associated, in a lower region and at the sole, with a frame which is usually U-shaped. The wings of the frame are directed towards the ground and two or more wheels are pivoted therebetween so as to be able to rotate freely and are thus mutually in-line.

Inside the rigid shell there is usually provided a soft innerboot suitable to improve the fit for the user.

These conventional skates, however, entail two drawbacks: the stiffness of the shell, which is required in order to allow optimum transmission of forces from the foot to the wheels, is in contrast with the need to allow an optimum fit of the skate. In fact in the sports practice, the stiffness causes pain to the user at the various pressure regions of the foot.

On the other hand, although a lesser stiffness of the shell slightly improves fit, it does not allow optimum transmission of forces from the foot to the wheels.

In an attempt to obviate these drawbacks, German patent DE-3 043 425 discloses a skate composed of a nonrigid upper containing an insole provided with pins or rivets which pass at the sole, at the upper, at suitable holes formed in a stiffening element, and then at a wheel or blade supporting frame.

The stiffening element is thus arranged outside the nonrigid shoe and is constituted by a rigid sole, by a toe cap and by a counter for the heel, which also acts as a partial rear support for the ankle.

Also this type of skate, however, entails drawbacks. Because of the external position of the stiffening element and to the shape of the heel counter, the stiffening element adheres to the foot imperfectly, thus offering a discontinuous support for said foot; for example, during forward flexing the stiffening element does not follow the ankle.

WO-95/15094 relates to a shoe for skates which is composed of an external structure, padded elements arranged inside said external structure, and a lining arranged inside the internal structure and inside the padded elements; its characteristic is that it has a plastic insert arranged between the external structure and the padded elements and comprises a U-shaped heel counter arranged in the heel region and a portion extending upward so as to affect the ankle.

Also this skate, however, entails drawbacks, since it does not cope with the need to provide lateral containment for the entire skate because no kind of structure is provided in the front part, and it does not offer adequate support for fixing to the wheel supporting frame. Moreover, it is structurally complicated, needing various production steps that require care in positioning the various components before mutually associating them.

SUMMARY OF THE INVENTION

An aim of the present invention is to solve the outlined technical problems, overcoming the drawbacks of the cited prior art, by providing a skate which at the same time allows optimum transmission of forces from the foot to the wheel supporting frame and optimum fit for the user's foot.

An important object of the present invention is to provide a skate which allows optimum lateral and longitudinal containment for the shoe that contains the user's foot for all the various stresses applied during sports practice.

A further important object of the present invention is to provide a skate which is structurally simple and easy to manufacture as to the shoe.

A further important object of the present invention is to provide a skate wherein the shoe wraps in an optimum manner around the foot of the user, locking the foot inside it and thus eliminating any relative movements during sports practice.

A further object of the present invention is to provide a skate which has low manufacturing costs and can be manufactured with conventional machines and equipment.

This aim, these objects and others which will become apparent hereinafter are achieved by a skate provided with a supporting frame for two or more wheels, characterized in that it comprises a shoe composed of a nonrigid upper which wraps in a sandwich-like fashion around a stiffening element affecting the regions of the tip, of the heel, of the ankle and of the sole of the foot, and a lateral band or rim made of rubber which externally and laterally wraps around said upper proximate to said region of the sole of the foot, an anchoring sole for said frame being formed thereat.

Advantageously, said stiffening element is provided with anchoring means for said lateral band or rim and upper.

Conveniently, said upper surrounds said stiffening element except for the region of the sole of the foot.

BRIEF DESCRIPTION OF THE DRAWINGS

Further characteristics and advantages of the skate according to the present invention will become apparent hereinafter from the following detailed description of two particular but not exclusive embodiments thereof, illustrated only by way of non-limitative example in the accompanying drawings, wherein.

DESCRIPTION OF THE PREFERRED EMBODIMENTS

Figure 1:
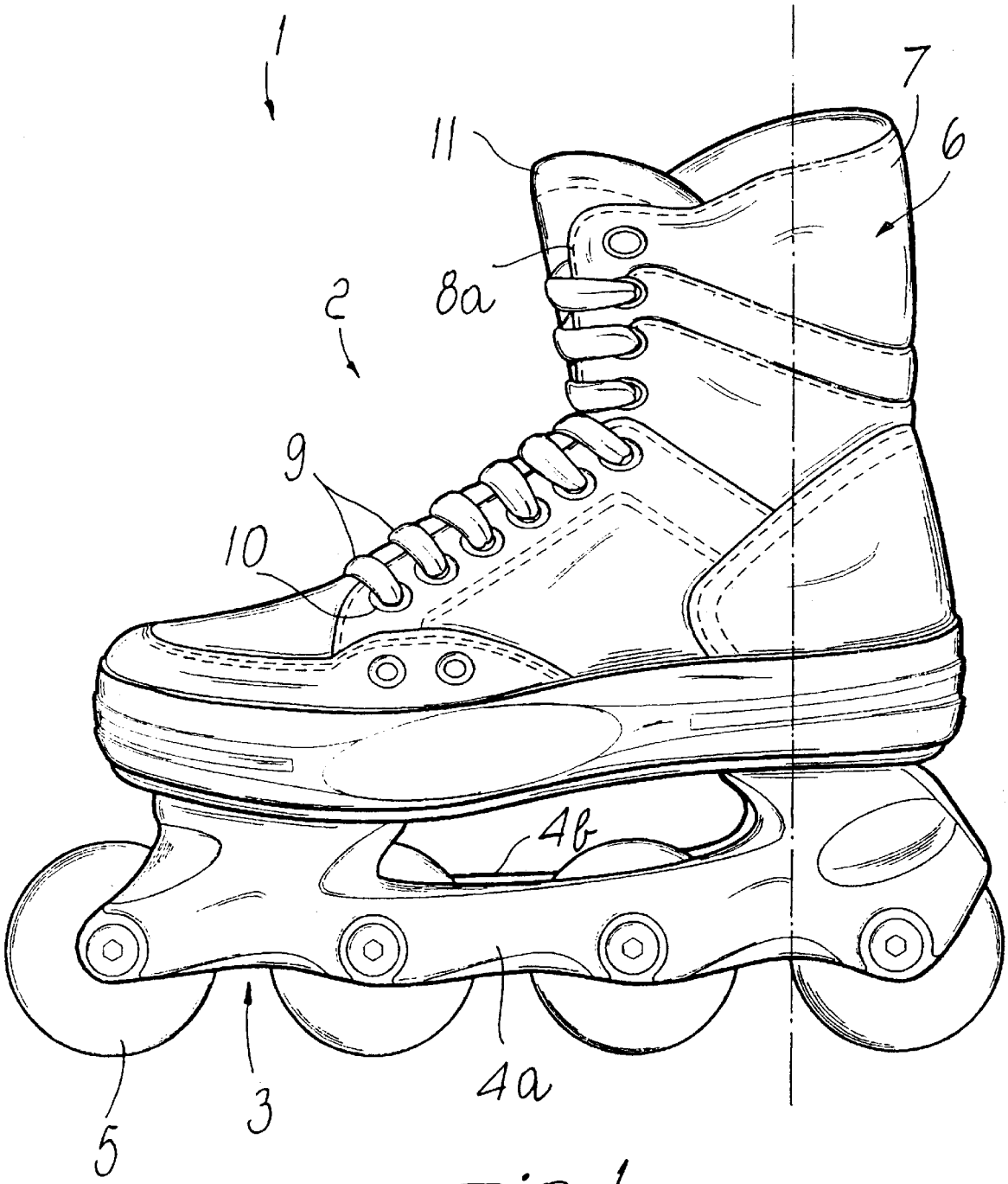
FIG. 1 is a side view of the skate.
Figure 2:
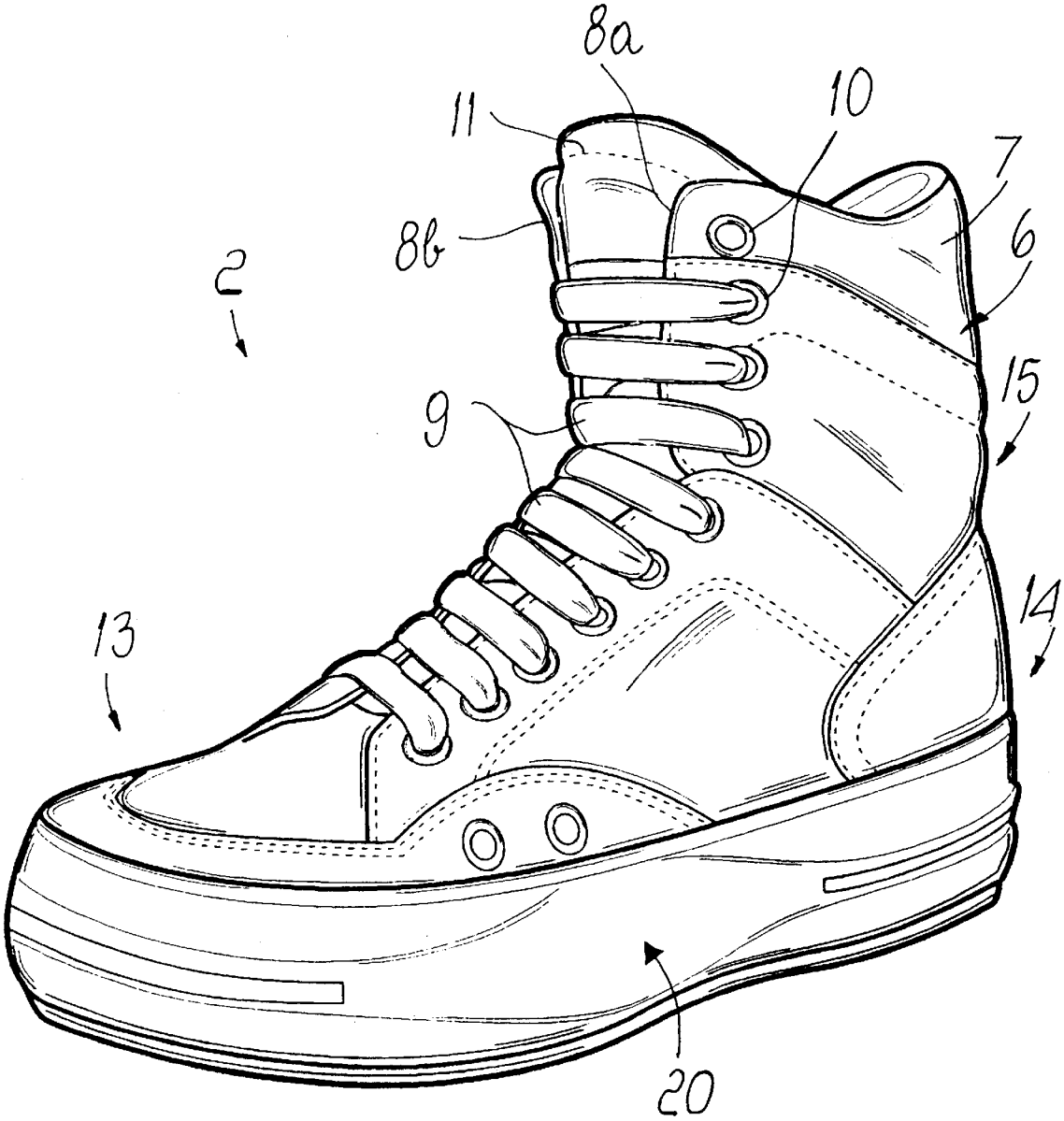
FIG. 2 is a lateral perspective view of the shoe alone.
Figure 3:
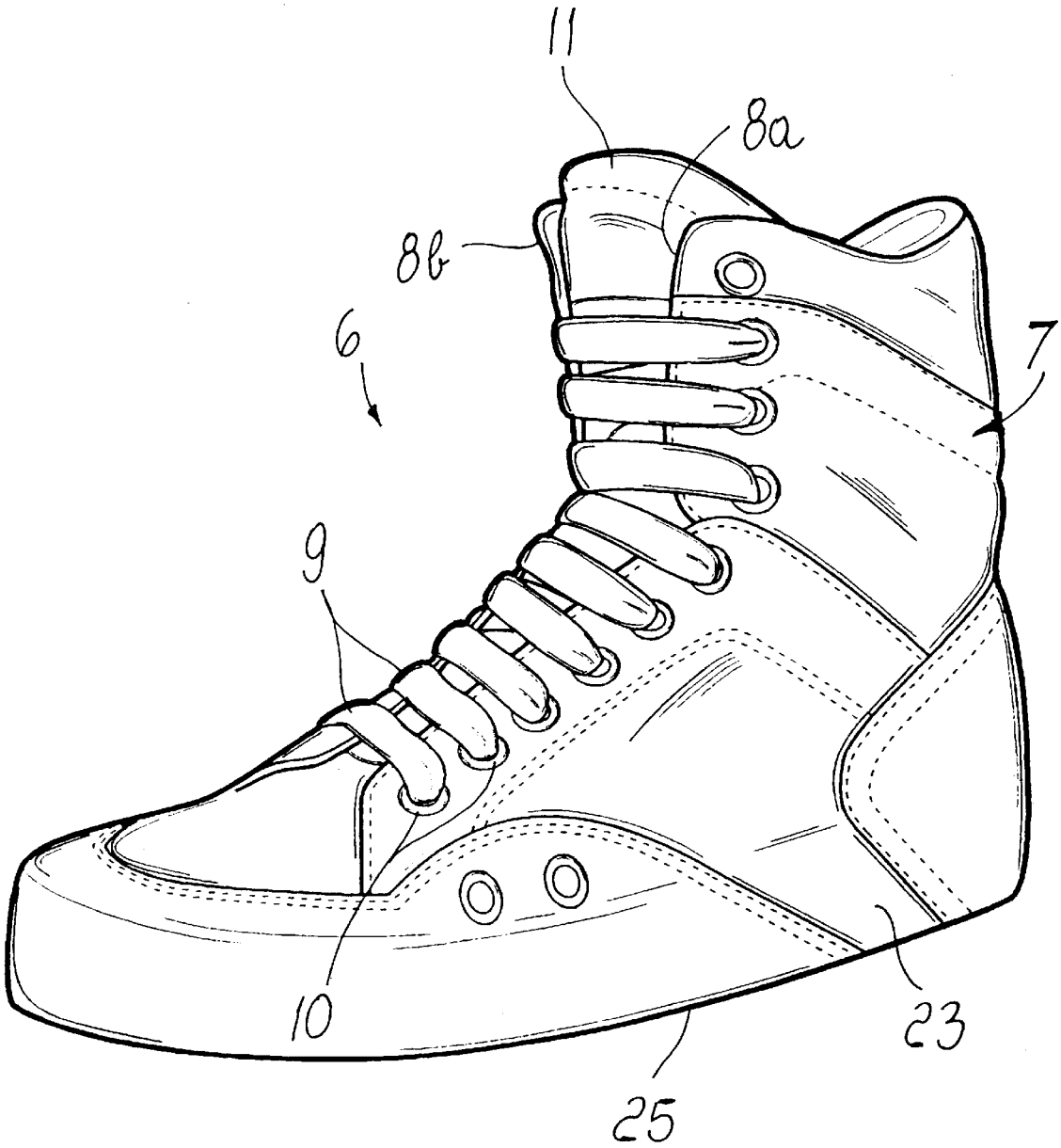
FIG. 3 is a view, similar to FIG. 2, of the upper without the band or rim.
Figure 4:
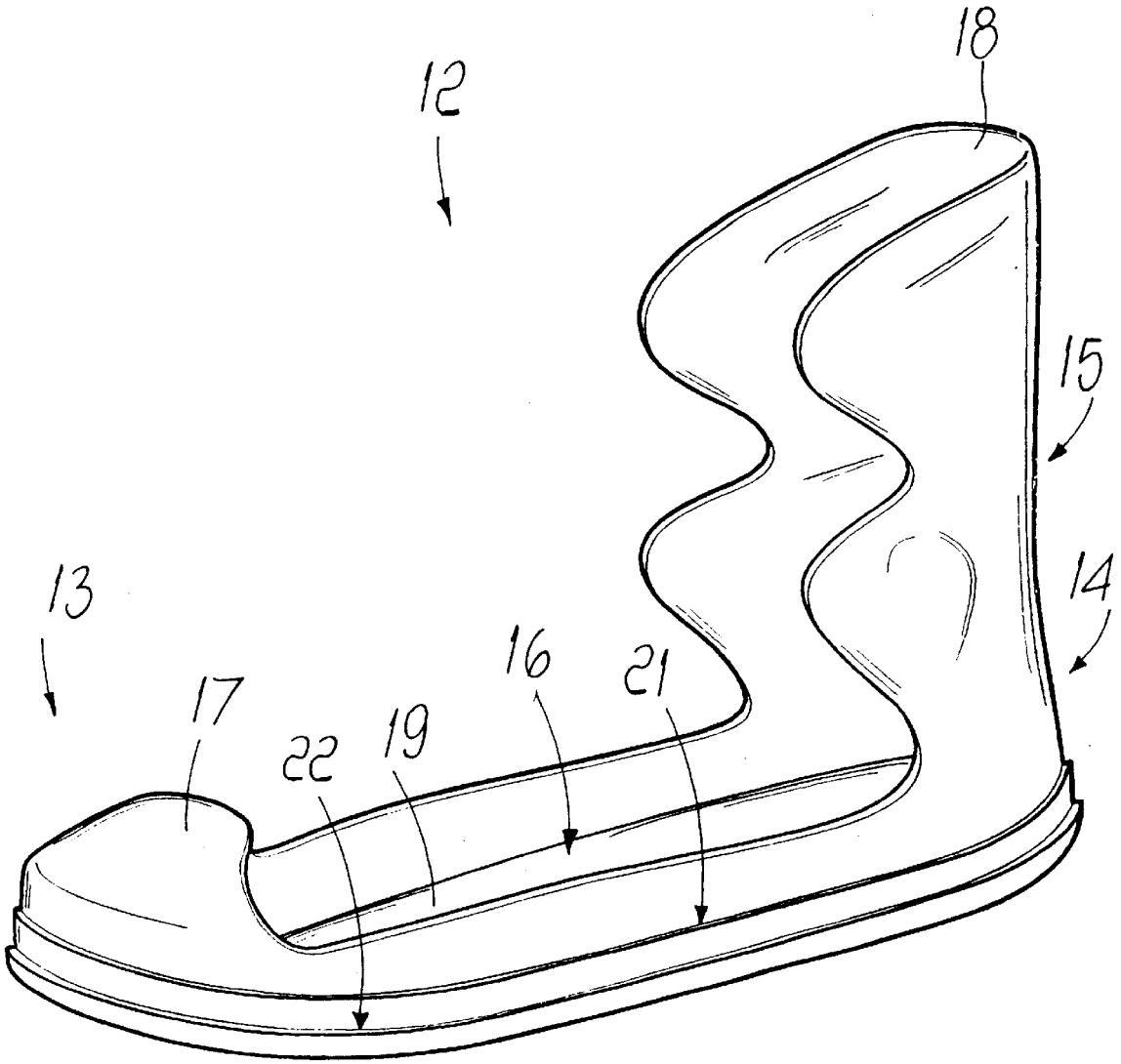
FIG. 4 is a view, similar to FIG. 3, of the stiffening element.
Figure 5:
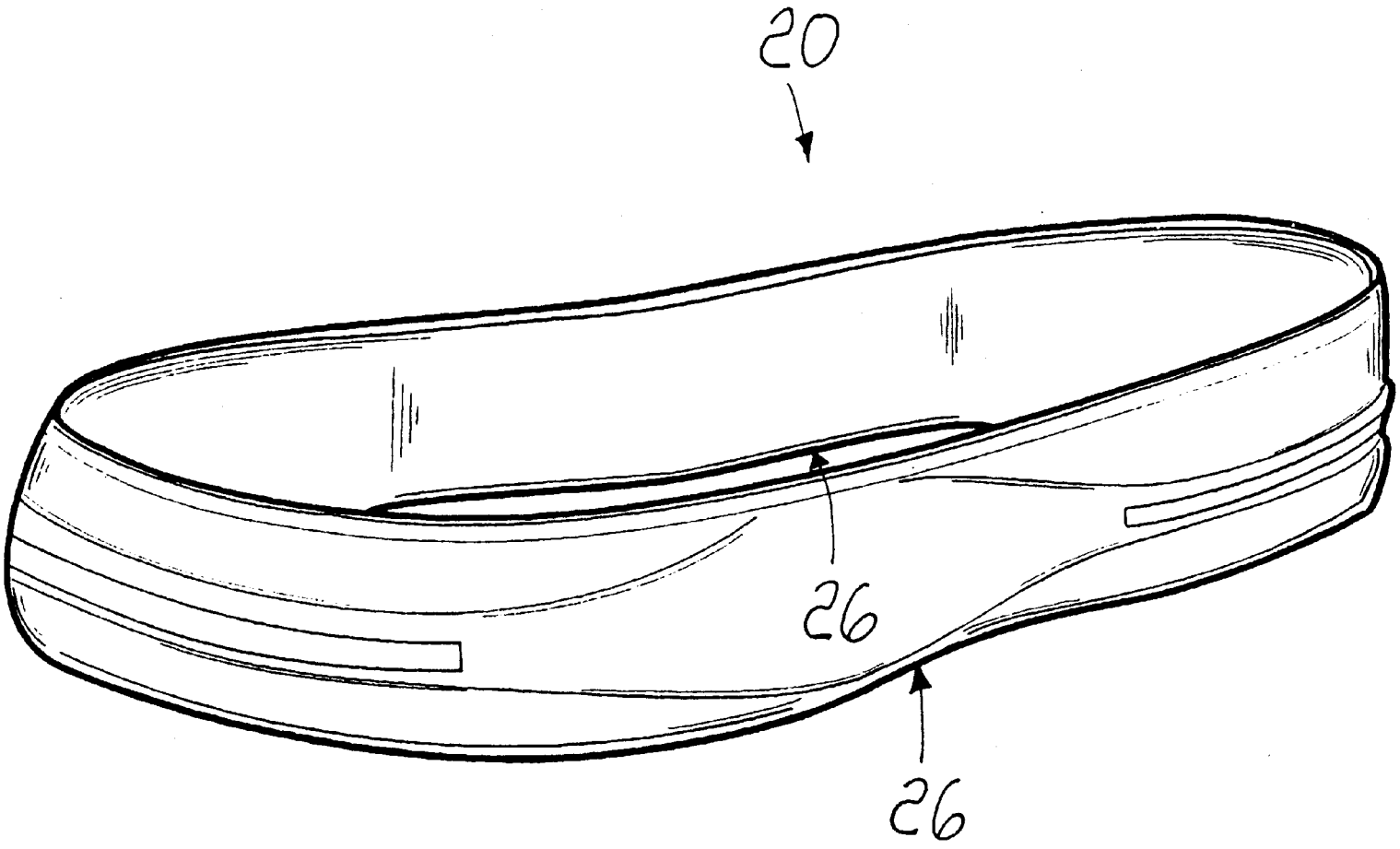
FIG. 5 is a view, similar to FIG. 4, of the band or rim.
Figure 6:
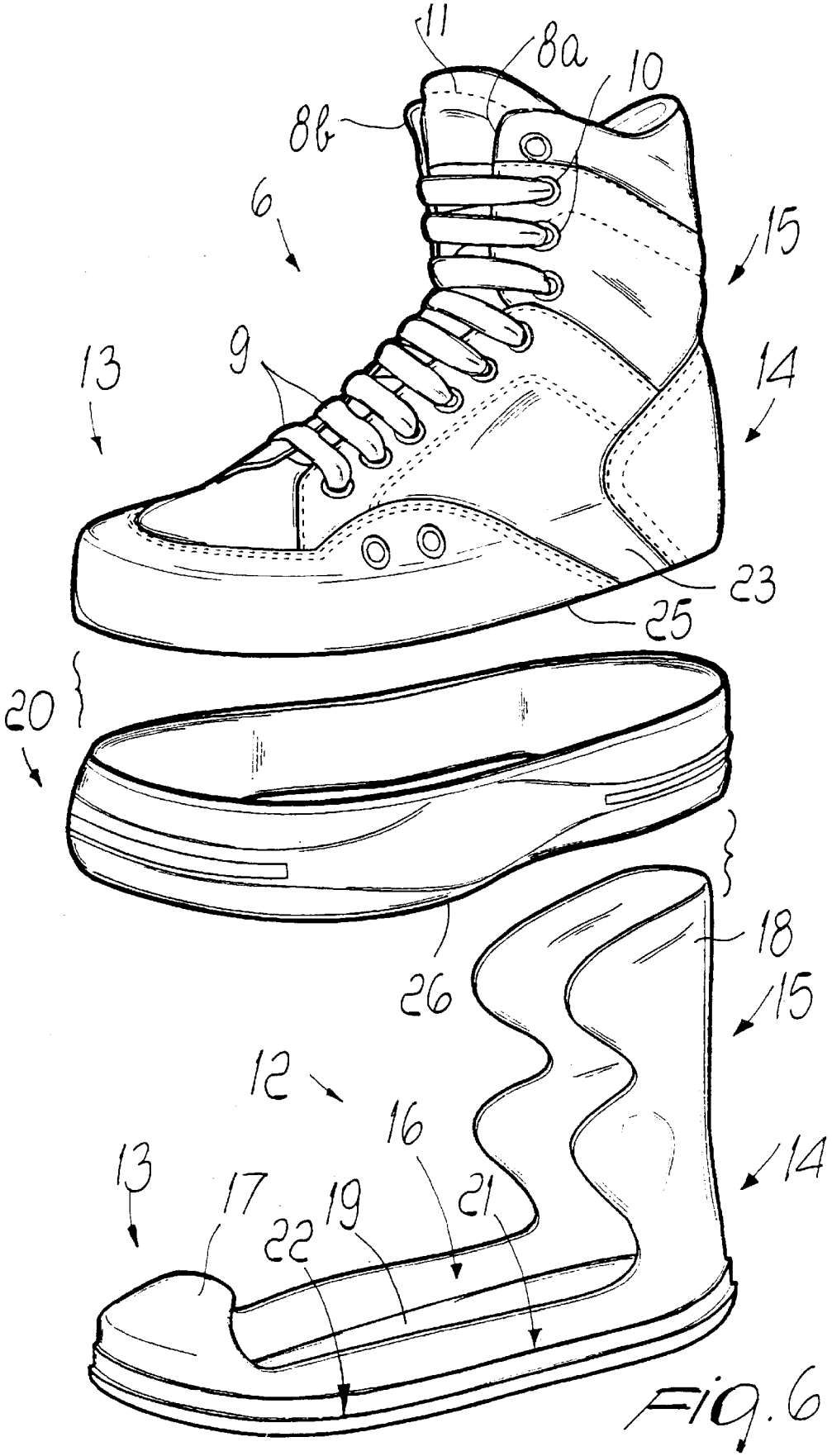
FIG. 6 is an exploded view of the upper, of the band or rim, and of the stiffening element.

With reference to the above figures, the reference numeral 1 designates a skate comprising a shoe 2 and a frame 3 substantially U-shaped; two or more wheels 5 are freely pivoted between the wings 4*a* and 4*b* of the frame.

The shoe 2 is constituted by an upper 6 which is nonrigid and accordingly made of a soft material that allows optimum adaptation to the anatomical shape of the foot.

The upper 6 can therefore be, for example, of the type used for leisure shoes and therefore comprising a cuff 7 which, in an upward region, surrounds the ankle area and, at the front, forms two flaps 8*a,* 8*b* which are opposite one another and can be fastened by means of a suitable closure means, such as for example laces 9 which pass at suitable pairs of eyelets 10 arranged transversely to the flaps.

Advantageously, the upper is also constituted by a central tongue 11 arranged adjacent to flaps 8*a*, 8*b*.

The shoe 2 comprises a stiffening element 12, made of a rigid material, such as for example thermoplastic material injected in a suitable mold. The stiffening element has a shape which affects the tip region 13, the heel region 14, the ankle region 15 and the region 16 of the sole of the foot.

Said stiffening element is formed monolithically and, at the tip region 13, is provided with a toe cap 17 which partially wraps around the tip of the foot. At the ankle region 14 and the heel region 15, the stiffening element is provided with a counter 18 which is substantially U-shaped in transverse cross-section and has approximately the same dimensions as the cuff 7 of the upper 6. At the region 16 of the sole of the foot, the stiffening element is provided with a substantially flat sole 19.

Proximate to the sole, and outside the stiffening element 12, an anchoring means is provided for a lateral band or rim 20 made of rubber. The anchoring means is constituted by a first ridge and a second ridge, designated by the reference numerals 21 and 22 respectively. The anchoring means forms a step with respect to the lateral surface of the stiffening element.

Figure 7:
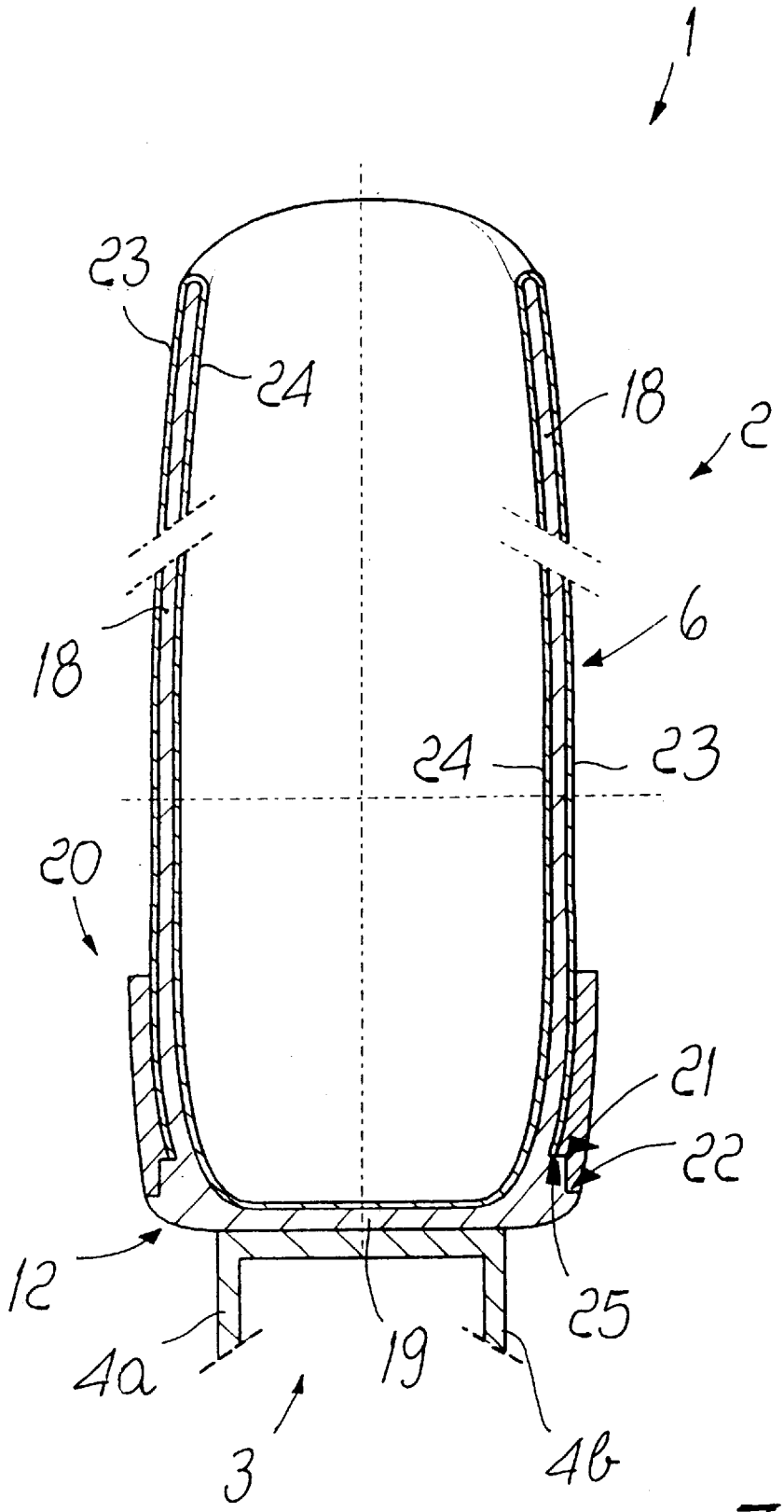
FIG. 7 is a sectional view, taken along a plane that lies transversely to the skate.

The stiffening element is inserted between a first outer wall 23 and a second inner wall 24 constituting the upper 6, so as to form a sandwich-like coupling, as shown in FIG. 7.

The second inner wall 24 also affects the region 16 of the sole of the foot, while the first outer wall 23 has a lower edge 25 which is made to abut at the first ridge 21 of the stiffening element 12.

Figure 8:
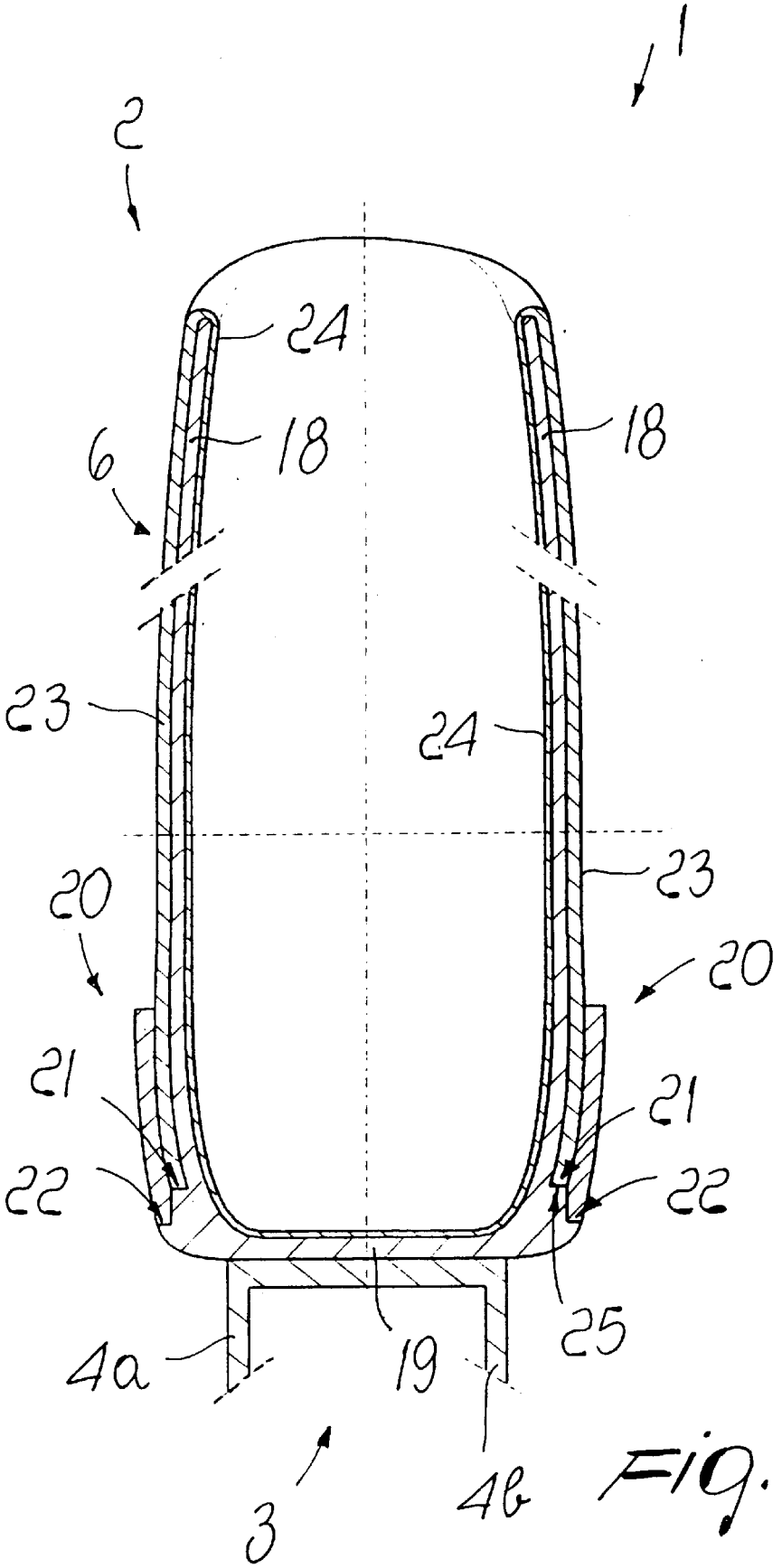
FIG. 8 is a view, similar to FIG. 7, of a different embodiment.

The first outer wall 23 can be thinner than the first ridge 21 is wide, as shown in FIG. 7, or can have the same dimensions, as shown in FIG. 8.

The second inner wall 24 can also act as an internal padding or lining.

The lateral band 20 overlaps part of the first outer wall 23 of the upper 6 and part of the stiffening element 12. As shown in FIG. 7, the band 20 has a lower edge 26 which is shaped complementarily to the second ridge 22 and partially complementarily to the first ridge 21 of the stiffening element 12 (as shown in FIG. 7) or is shaped complementarily only to the second ridge 22 (as shown in FIG. 8).

The thickness of the lateral band 20 is thus equal either to the sum of the width of the second ridge 22 and of the first ridge 21, minus the thickness of the first outside wall 23 and of the upper 6, or to the thickness of the second ridge 22.

The lateral band 20 is formed and coupled using known technologies, such as for example gluing, vulcanization or others.

Figure 9:
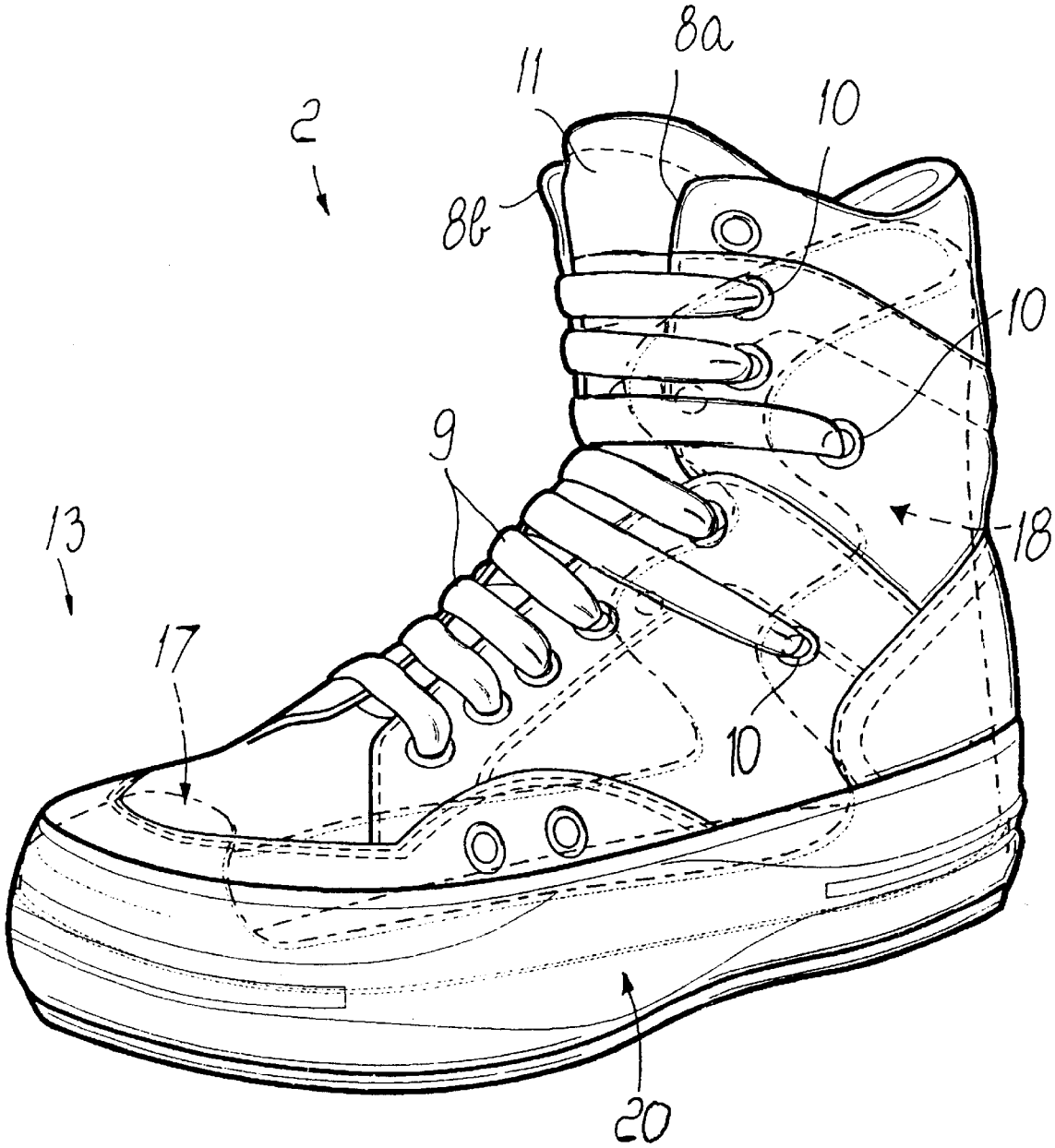
FIG. 9 is a view of a different embodiment of the shoe.

Further, as regards the mutual connection of the flaps 8*a*, 8*b*, the devices used, such as for example the laces 9, can affect suitable eyelets 10 formed so as to affect both the upper 6 and the stiffening element 12, as shown in the embodiment of FIG. 9.

It has thus been observed that the invention thus conceived has achieved the intended aim and objects, a skate having been provided which has at the same time an optimum ability to transmit forces from the foot to the wheel supporting frame and an optimum fit for the user's foot.

The skate according to the present invention thus allows to achieve optimum lateral and longitudinal containment for the shoe containing the user's foot for all the various stresses applied during sports practice; the skate also comprises a shoe which is structurally simple and easy to manufacture and the foot is wrapped inside it in an optimum manner.

The skate according to the present invention is of course susceptible of numerous modifications and variations, all of which are within the scope of the same inventive concept.

The materials and the dimensions that constitute the individual components of the skate may of course be the most pertinent according to specific requirements.

What is claimed is:

1. A skate comprising;

a shoe having a nonrigid upper;

a frame connected to said shoe for supporting a plurality of wheels;

a rigid stiffening element connected with said upper and having a tip stiffening region, a heel stiffening region, an ankle stiffening region, and an anchoring sole stiffening region for supporting said frame; and a lateral band made of rubber which externally and laterally surrounds said upper proximate to a sole region of the shoe;

said stiffening element comprising a first ridge which protrudes from a lateral surface of said stiffening element adjacent said sole region of the shoe, and said upper comprising an outer wall portion which externally covers said stiffening element and which has a lower edge arranged in abutting engagement with said first ridge of said stiffening element, and said lateral band externally and laterally surrounding said first ridge of said stiffening element and said lower edge of said outer wall portion of said upper mutually arranged in said abutting engagement.

2. A skate according to claim 1, wherein said nonrigid upper comprises an upper ankle cuff having two mutually opposite front flaps which can be releasably fastened by means of a closure means.

3. A skate according to claim 2, wherein said stiffening element is formed monolithically and comprises: at said tip stiffening region, a toe cup for partially surrounding a tip of a user's foot; at said heel stiffening region and said ankle stiffening region, a counter which is substantially U-shaped in a transverse cross-section and has dimensions which are approximately equal to those of said upper ankle cuff of said upper; and at said anchoring sole stiffening region, a sole which is substantially flat.

4. A skate according to claim 1, wherein said stiffening element further comprises a second ridge arranged below said first ridge and protruding from said first ridge, said lateral band comprising a lower edge arranged in abutting engagement with said second ridge of said stiffening element.

5. A skate according to claim 1, wherein said upper further comprises an inner wall portion, said stiffening element being inserted between said outer wall portion of said upper and said inner wall portion of said upper.

6. A skate according to claim 5, wherein said inner wall portion of said upper also extends at said sole region of the shoe.

7. A skate according to claim 1, wherein said outer wall portion of said upper is thinner than a protruding width of said first ridge.

8. A skate according to claim 1, wherein said outer wall portion of said upper has a thickness which is equal to a protruding width of said first ridge.

9. A skate according to claim 4, wherein said lateral band is superimposed over a part of said outer wall portion of said upper and over said first ridge of said stiffening element.

10. A skate according to claim 9, wherein said lateral band has a thickness which is equal to a protruding width of said second ridge.

11. A skate according to claim 2, wherein said closure means comprise eyelets formed in both said upper and said stiffening element, and laces passing through said eyelets.

12. A skate according to claim 4, wherein said upper further comprises an inner wall portion, said stiffening element being inserted between said outer wall portion of said upper and said inner wall portion of said upper.

13. A skate according to claim 12, wherein said inner wall portion of said upper also extends at said sole region of the shoe.

14. A skate according to claim 4, wherein said outer wall portion of said upper is thinner than a protruding width of said first ridge.

15. A skate according to claim 4, wherein said outer wall portion of said upper has a thickness which is equal to a protruding width of said first ridge.

16. A skate according to claim 14, wherein said outer wall portion of said upper is thinner than a protruding width of said first ridge.

17. A skate according to claim 14, wherein said outer wall portion of said upper has a thickness which is equal to a protruding width of said first ridge.

18. A skate according to claim 16, wherein said lateral band is superimposed over a part of said outer wall portion of said upper and over said first ridge of said stiffening element, and wherein said lateral band has a thickness which is equal to a protruding width of said second ridge.

19. A skate according to claim 17, wherein said lateral band is superimposed over a part of said outer wall portion of said upper and over said first ridge of said stiffening element, and wherein said lateral band has a thickness which is equal to a protruding width of said second ridge.

* * * * *